United States Patent [19]

Ruckstuhl

[11] 4,037,762

[45] July 26, 1977

[54] PROTECTIVE NOZZLE FOR THE OUTLET OF A CASTING LADLE

[75] Inventor: Franz Ruckstuhl, Schwerzenbach, Switzerland

[73] Assignee: Metacon AG, Zurich, Switzerland

[21] Appl. No.: 648,740

[22] Filed: Jan. 13, 1976

[30] Foreign Application Priority Data

Jan. 23, 1975 Switzerland ..... 818/75

[51] Int. Cl.[2] ..... B22D 41/08

[52] U.S. Cl. ..... 222/591; 222/600

[58] Field of Search ..... 222/561, 591, 600; 52/223 L, 705, 740, 736, 739

[56] References Cited

U.S. PATENT DOCUMENTS

| | | | |
|---|---|---|---|
| 1,227,627 | 5/1917 | Kennedy | 52/705 X |
| 1,416,117 | 5/1922 | Muir | 52/740 |
| 3,567,082 | 3/1971 | Tinnes | 222/600 |
| 3,731,912 | 5/1973 | Kutzer | 222/561 X |

FOREIGN PATENT DOCUMENTS

| | | | |
|---|---|---|---|
| 1,150,380 | 1/1958 | France | 52/705 |
| 551,817 | 3/1943 | United Kingdom | 52/740 |

*Primary Examiner*—Robert B. Reeves
*Assistant Examiner*—David A. Scherbel
*Attorney, Agent, or Firm*—Cushman, Darby & Cushman

[57] ABSTRACT

A protective nozzle for the outlet passage of a casting ladle includes a body having a conical shape and a through bore with the exterior side surfaces of the body having projections or ridges which aid in the retention and establishing of a mortar joint between the wall of the outlet of the casting ladle and the exterior surface of the nozzle so as to prevent the possibility of the mortar material being washed out of the joint between the nozzle and the walls of the outlet passage of the casting ladle during a casting operation.

8 Claims, 6 Drawing Figures

17
18
16
31
12
19
13
15
10
11
20
23
21
22

39
30
36
30'
18
31'
14
31
15
33
41
34
35
10
15
36
40
10'
32
37
38
20

PROTECTIVE NOZZLE FOR THE OUTLET OF A CASTING LADLE

BACKGROUND AND BRIEF DESCRIPTION OF THE INVENTION

The present invention relates to apparatus for casting molten metals and, more particularly, to protective inserts or nozzles which have through bores and which are disposed in the outlet passageways of a casting ladle to protect the surfaces of the outlet passage from wear and deterioration that would result from contact with the molten metal.

In the field of handling molten materials, there is occasion to employ nozzles or casings in a variety of instances, for example, not only with casting ladles, but also in intermediate containers and distribution chutes or at the ends of funnels in order to protect the outlet passageways of such elements against wear and deterioration. To this end, the prior art has suggested the use of pipes in the form of funnels, or specifically prepared blocks or bricks which are set in place in the outlet passages of the molten metal containers.

Since the protective inserts for the outlet passageways of such containers are exposed to the heat of the molten metal directly, over a period of time, replacement of such inserts becomes necessary. In the production of the materials for the containers and protective inserts or nozzles, in order to reduce manufacturing costs, considerable inaccuracies are tolerated, particularly since mortar material can be employed to form the joints between the assembled parts and, in any event, since the precise fit between such parts are impossible to obtain on a commercial scale. Accordingly, depending on the quality of the mortar material employed, such mortar material must serve not only to fill the joints between the parts, but also must have sufficient strength when solidified as to resist mechanical stresses which are built up between the joined bodies.

This is particularly true where the mortar joints are disposed between two engaging bodies which have variable expansion characteristics at the temperatures experienced in a molten metal casting operation. Specifically, in the case of a nozzle for a casting ladle through which molten metal flows, the insert or nozzle shields the outlet passage from direct contact with the molten metal so that the expansion of the insert will naturally be greater, since it is directly exposed to the molten metal, than any expansion that occurs in the outlet passage of the ladle itself. In such environments, the mortar material which, in general, has a higher plasticity than the nozzle, as well as the outlet passage of the ladle which is at a lower temperature, can serve as an equalizing layer which will distribute forces of expansion originating in the nozzle and thus, tends to prevent any damaging of the outlet passage of the casting ladle or the casting ladle itself.

Apart from the fact that damage to the casting ladle outlet passage is avoided by the use of mortar in the joint between the passageway and nozzle, it is still very difficult to assure the exact centering of the nozzle insert in the outlet passageway due chiefly to the fact that the casting ladle itself, as well as its outlet passageway, are at an elevated temperature.

Another difficulty that has been encountered arises during the application of the mortar to one or the other of the surfaces to be joined together. In general, the adhesion of the relatively stiff mass of mortar to the surfaces is relatively great due to the very rough character of these surfaces which are made of fire-resistant material. This characteristic of the surfaces also renders even distribution of the mortar on the surfaces complicated.

One well known problem that has been long encountered in this field is the difficulty of properly proportioning the quantity of mortar on one or the other of the surfaces so as to allow the proper insertion of the protective insert or nozzle into the outlet passageway. An improper distribution or proportioning of the quantity of mortar will obviously affect adversely the centering of the insert in the outlet passageway and may result, when the mortar hardens, in a deviation in the position of the nozzle in the passageway, both with respect to the axial position as well as its transverse position. This problem is accentuated by the fact that when mortar comes into contact with the hot casting ladle passageway, it begins to immediately set up to form a bond which renders repositioning of the insert or nozzle difficult, if not impossible. Cooling of the casting ladle outlet passage is impractical since it must be done very slowly to avoid cracking of the material.

As a result of these conditions, it has become necessary to apply the entire quantity of mortar material to the exterior surface of the nozzle insert. However, upon pushing the nozzle insert thus coated with mortar material into the outlet passageway of the casting ladle, invariably portions of the mortar are stripped away, particularly at the innermost portion of the passageway thus resulting in the undesirable condition that the innermost portion of the joint will not be filled with mortar material. As a result, the achieving of a stable seating of the insert nozzle will not be assured.

Another danger that results from the condition described above exists where the mortar material itself is exposed to the flow of molten metal since, here, the mortar must function to prevent the flow of molten metal through the joint. Thus, it can be appreciated, where the joint is not completely filled with the mortar, not only is part of the passageway exposed to the molten metal, but there is a substantially increased danger that the mortar material will be washed out. This is particularly dangerous when one considers that in many circumstances, it is not possible to visually inspect the interior filling of the joint.

The present invention has for its primary object to overcome the foregoing difficulties by providing novel means for carrying the mortar material on the exterior surface of the nozzle insert to facilitate the insertion of the nozzle and mortar material into the outlet passage of a molten material container.

The present invention takes advantage of the fact that conventionally, the thickness of the mortar joint is sufficiently large so as to assure the production of a sufficiently strong joint. Thus, the novel protective insert for a nozzle can be employed in already existing casting apparatus.

In summary, according to the present invention, the protective insert or nozzle is in the form of a truncated cone having a through bore or passageway where the conical surface of the insert is provided with raised surfaces or ridges having specific dimensions.

By raised surfaces, it is to be understood in the context of the present invention, such elevation, the dimensions of which exceed the normally rough surfaces found on such materials as a result of conventional production procedures and which do not exceed the thickness of the joint or gap which, in the past, has ideally been fully occupied by mortar material.

By virtue of the provision of the raised portions, ridges or projections on the exterior surface of the truncated cone, according to the present invention, not only is the application of mortar onto this surface facilitated, but also the proportioning and distribution of the mortar material over the exterior surface of the nozzle is made easier since the spaces between the raised portions will be entirely filled with mortar material. Accumulations of mortar can occur with this arrangement only at a distance greater than the heigth of the projections from the surface of the truncated cone. The adherence of the mortar to the surface of the protective insert provided with the raised surface portion is enhanced which will naturally have an effect on the residual thickness of the mortar layer. This will materially contribute to assuring that the mortar joint, when the elements are assembled, will be completely filled.

One of the chief advantages of the development of the present invention resides in the fact that it now will be possible to properly center the nozzle directly into the outlet passageway of the casting ladle thus minimizing the possibility of uneven expansion of the nozzle insert causing damage to the adjoining elements of the casting ladle.

Thus, according to the present invention, the raised portions or elevations on the surface of the truncated cone of the protective nozzle insert facilitate distribution and proportioning of the mortar over the surface of the insert as well as facilitate carrying of the mortar material into the outlet passageway on the exterior surface of the insert and also serve to assure proper centering of the cone-shaped insert in the outlet opening of the casting ladle. Additionally, it will be noted that these raised surface portions will occupy a portion of the joint volume itself, thus decreasing the danger of perforation or washing out of the mortar material by the molten metal.

the foregoing and other advantages will become apparent as consideration is given to the following detailed description and the accompanying drawings, in which:

DETAILED DESCRIPTION OF THE INVENTION

Figure 1:
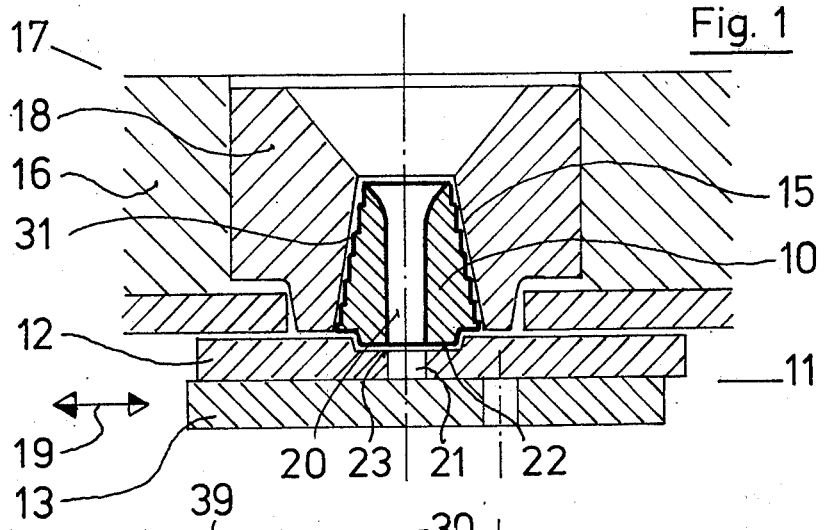
FIG. 1 is a sectional view in elevation of the outlet of a casting ladle with a gate-type slide valve and a nozzle insert.

Referring to FIG. 1 there is shown a nozzle insert 10 which is used as a protective insert for the outlet passage of a casting ladle which is also provided with a sliding type gate valve 11. The gate valve 11 has been shown in simplified form in the drawing and comprises a bottom plate 12 and a sliding plate 13, both of which are apertured, with the plate 13 movably longitudinally in the direction of the arrows 19.

Figure 2:
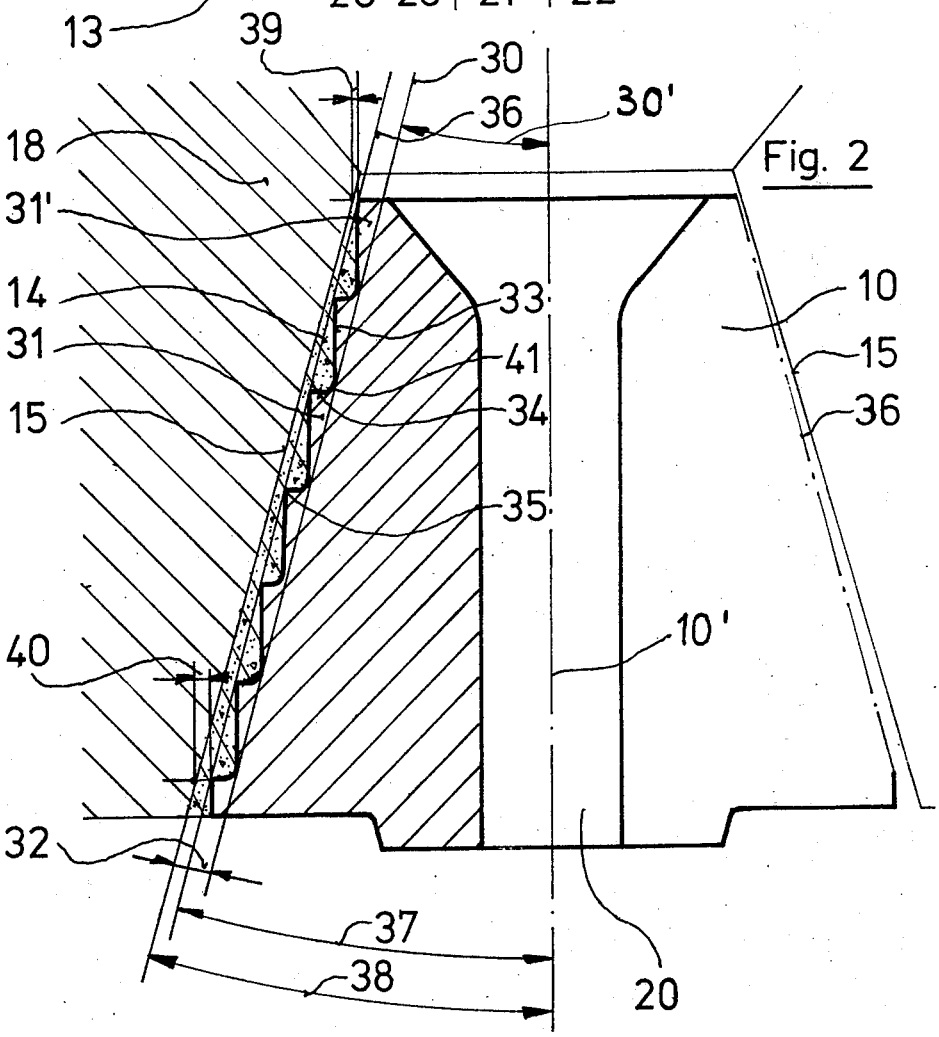
FIG. 2 is an enlarged, elevational view, partly in section of the improved nozzle insert of the present invention.

As shown more clearly in FIG. 2, the nozzle insert 10, which is made of highly fire-resistant material, has the form of a truncated cone, which on its lateral side, indicated by the straight line generatrix 30, has a series of projections or elevations 31 formed thereon about the entire circumference of the nozzle 10. The nozzle 10 is inserted with a coating of mortar 14 concentrically into the conical bore 15 which constitutes the outlet passage of the casting ladle 17. The conical bore 15 is formed in a nozzle brick 18 which, as is conventional, is connected firmly with the bottom wall 16 of the casting ladle 17 which is only partially shown in FIG. 1. It is important that the through bore or passage 20 of the nozzle 10 be aligned precisely with the outlet passage 21 of the bottom plate 12 and, to this end, the flat front surface 22 of the nozzle 10 and the flat grooved surface 23 of the plate 12 should closely interfit so as to be parallel to one another.

Referring again to FIG. 2, in the embodiment shown therein, the elevations or ridges 31 have the shape of ribs extending about the peripheral circumference of the nozzle 10 and are distributed evenly over its axial length. The lateral surface area indicated by the straight line generatrix 30 would normally define the exterior surface of a conventional nozzle insert relative to the diameter of the conical bore 15. As shown in section, the ribs 31 are essentially in the form of steps, each having a flank 33 and a shoulder 34. The radial distance 32 between the lateral surface of the nozzle 10 and the surface of the wall of the bore 15 is approximately equally as large as the width of a joint tht has been conventially used in previously known nozzle inserts. However, according to the present invention, the ribs 31 occupy a considerable volume of the joint relative to what has been the case.

The edges 35 of the ribs 31 between the flanks 33 and shoulders 34 lie on a virtual boundary or envelope surface which is defined by a generatrix 36 and which is coaxial with respect to the surface defined by the generatrix 30. An angle 37 formed between the generatrix 36 and the axis 10' of insert 10 opens to the same side as an angle 30' formed between this axis 10' and the generatrix 30. In other words, the cone shaped exterior surface defined by generatrix 30 narrows in the same direction as the virtual boundary surface defined by generatrix 36. While angle 30' is shown to be equal in magnitude as angle 37, it may also be larger or smaller, as will be seen to be the case with the embodiment of FIG. 4, if desired.

When the exterior surface of the nozzle insert 10 is coated with motar, the ribs 31 form guides for the proportioning of the quantity and for the distribution of the mortar that is applied. When the mortar is applied with a trowel, the edges 35 can serve to strip the mortar from the trowel and retain it on the surface of the nozzle inset 10. Additionally, a worker will be able to determine immediately whether sufficient motar has been applied to the surface of the nozzle insert 10 by observing simply when the edges 35 of the ribs 31 are covered with mortar. This has the advantage that localized accumulation of too much mortar can be avoided easily, thus assuring that proper insertion of the nozzle 10 into the bore 15 will be accomplished.

As previously noted, the provision of the ribs 31 will improve the adhesion of the motar to the surface of the nozzle insert 10. This is particularly important during insertion of the nozzle 10 into the boxes 15, since only a small quantity of the mortar will be stripped off during the insertion, by virtue of the fact that the ribs 31 will impede flow of the mortar along the surface of the nozzle insert 10, as well as along the wall of the bore 15. Thus, mortar will be present in the joint in the proper thickness thus, assuring the appropriate positioning of the nozzle insert 10 in the bore 15 which is particularly important whenever the surface of the bore 15 is hot and/or quick bonding mortar is being employed.

When in the inserted position, the edges 35 of the ribs 31 are directly adjacent to the wall surface of the bore 15 and thus, contribute to an effective sealing against penetration of the molten material into the joint. As a result, the danger of the mortar material being washed out by the molten metal will be substantially, if not entirely eliminated.

Generatrix 30 and generatrix 36 may extend parallel to the surface of the wall of the bore 15 or, as shown on the left hand side of FIG. 2, they can be disposed to extend on an angle to the wall of bore 15. In this latter case, the angle designated 37 is smaller than the cone angle 38 of the bore 15 and the width 39 of the joint at the entry point of the nozzle 10 will be smaller than the width 40 at the outlet end. Thus will be achieved the desirable configuration that the joint is nearest to the molten metal will have the smallest dimensions, thus impeding the washout of the mortar material in the joint.

In some cases, it may be desirable to eliminate the mortar-filled joint entirely at the uppermost section of the nozzle insert 10, for example, where the operating temperature difference between the nozzle brick 18 and the nozzle insert 10 is smallest and where the coefficient of thermal expansion of the nozzle insert 10 and the nozzle brick are very close to one another. In such a circumstance, it is useful to dimension the nozzle in such a way that at its extreme upper end, rib 31', which will lie closest to the molten metal, will touch the wall surface of the bore 15 about its entire periphery when the nozzle insert 10 is inserted into the bore 15. This will have the advantage that the centering of the nozzle insert 10 will be effected by direct contact with the smallest cross-section of the bore 15 in the nozzle brick 18. Of course, the difference between the angle 38 and 37 will permit some alignment of the lower end of the nozzle insert 10 with the predetermined or fixed axis position of the passage 21 in plate 12. However, even in such a circumstance, the central axis 10' of the nozzle 10 can enclose an angle with the generatrix axis of the nozzle brick 18, while the lock constituted by the topmost rib 31', which prevents washing out of the mortar from the joint, is retained.

In order to facilitate manufacturing of the nozzle insert 10 from the one-piece mold, the flank 33 of the ribs 31 may be made slightly conical relative to the direction of insertion of the nozzle insert 10 into bore 15 while the edges 35 may be formed at obtuse angles instead of 90° angles. On the same ground, the flank 33 may join a shoulder 34 by way of a curved portion 41 so as to decrease the danger of fissures forming.

Figure 3:
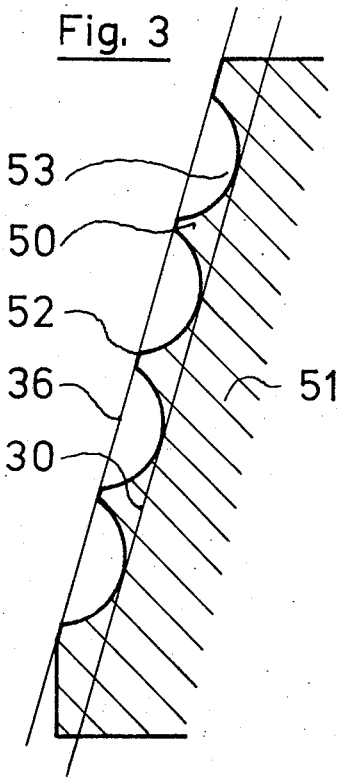
FIG. 3 is an enlarged sectional view with parts broken away of another embodiment of the present invention.

With reference now to FIG. 3, there is shown an alternate embodiment of the present invention where a different form of raised surface portions on the lateral side of the nozzle insert designated 51 in FIG. 3, is provided. Specifically, the raised surfaces are in the form of rib-shaped elevations 50 which extend about the circumference of the exterior surface of the nozzle insert 51. The ribs 50 in FIG. 3 are spaced from one another by semi-circular or arc-shaped indentations 53. The flat surfaces 52 at the extremities of each rib 50 lie along the generatrix axis 36 of the virtual envelope or boundary surface defined thereby. By forming flat surfaces 52 at the top of each rib 36, the possibility of damage to the ribs during voltage and handling of the nozzle insert 51 will be decreased.

Figure 4:
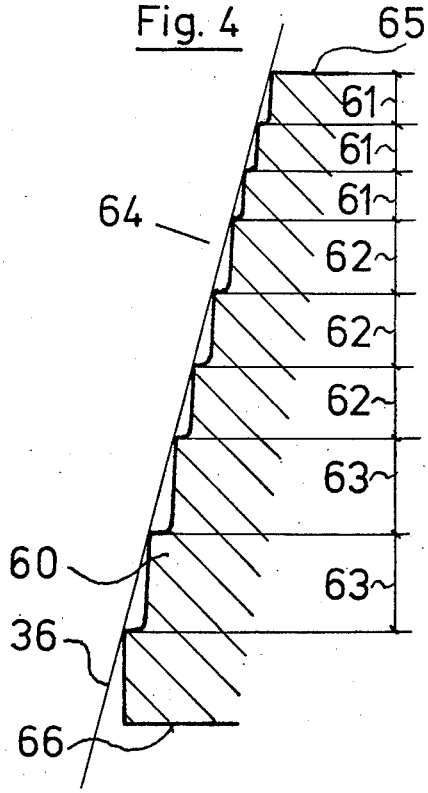
FIG. 4 is a view similar to that of FIG. 3 showing another embodiment of the present invention.

In FIG. 4, there is illustrated a nozzle insert 64 which is another embodiment of the present invention. The nozzle insert 64 has a series of elevations 60 which in cross-section are in the form of steps each of which extends about the circumference of the exterior surface of the nozzle insert 64. In distinction from the embodiment illustrated in FIGS. 1 and 2, the elevations 60 of FIG. 4 are not distributed evenly over the axial length of the nozzle insert. Instead, the axial distances 61 of the elevation 60 adjacent the smaller end of the conical nozzle insert 64 are reduced relative to the lengths 62 over the mid region of the axis between the distances 63 constitute the largest length dimension and are disposed adjacent the larger diameter end portion of the nozzle insert. This arrangement takes into account the fact that the tapered end 65 of the nozzle insert 64 is located closer to the molten metal during a casting operation and, with this arrangement, a greater number of edges will be presented to reinforce the mortar material against the possibility of the molten metal washing out the mortar.

Figure 5:
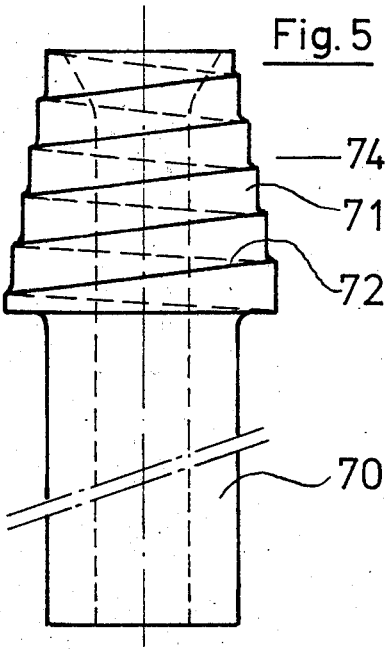
FIG. 5 is a side view in elevation of another embodiment of the present invention.

In FIG. 5, there is illustrated another advantageous embodiment of the nozzle insert of the present invention which is useful where immersion of the outlet into a bath is required as in the case of sami-continuous casting processes. In this embodiment, the immersion nozzle 70 has a truncated cone-shaped part 74 which is provided with raised elevation 71 in the form of a spiral-shaped right-hand conical thread. With this arrangement, by turning the nozzle insert 70 to the left, as it is being inserted into the conical bore of a casting ladle outlet, the mortar applied to the cone-shaped surface 74 will be moved in the direction of insertion of the nozzle insert so as to be compressed in the interval 72 between the elevation 71.

It will be appreciated that the nozzle inserts, according to the present invention, can be used as replacement inserts in an outlet of a casting ladle or other molten metal containers regardless of whether or not the quality of the material of the outlet itself is better or worse in terms of wear resistane than the material of the nozzle insert.

It has been found that it is possible to permit the extremities of the elevations or projections on the nozzle inserts of the present invention to contact the wall of the bore into which the nozzle insert is placed and fixed by mortar. Although the nozzle insert experiences a greater degree of heat expansion than the wall of the bore there is a sufficient decrease in the brittleness of the material of the nozzle insert in hot condition which will permit the elevations or projections on the nozzle insert to deform sufficiently when the nozzle insert undergoes expansion. Of course, certain shapes for the elevations, such as that as illustrated in FIG. 3, are particularly advantageous in this regard where the elevations are in the form of a thread or a set of parallel circumferential ribs. Of course, where such overall contact of the elevation or projection with the wall of the bore is obtained, a centering of the nozzle insert in the bore is greatly facilitated even though the necessity of aligning the aperture 21 with the bore 20 of the nozzle insert must still be taken into account.

However, where such intimate contact between the projections of the nozzle insert and the wall of the bore are desired, difficulty may be encountered in positioning the nozzle insert in the bore due to the presence of the mortar material on the surface of the nozzle insert, particularly where the projections are in the form of continuous ribs or threads which run transversely continuously about the periphery of the exterior surface of the nozzle insert.

In such circumstances, according to the present invention; a plurality of space projections may be provided in place of the continuous ribs or threads described above. Also, the continuity of the ribs of threads may be broken by providing axial grooves in the ribs to permit the passage of excess mortar material therethrough when the nozzle insert is inserted into the bore.

Figure 6:
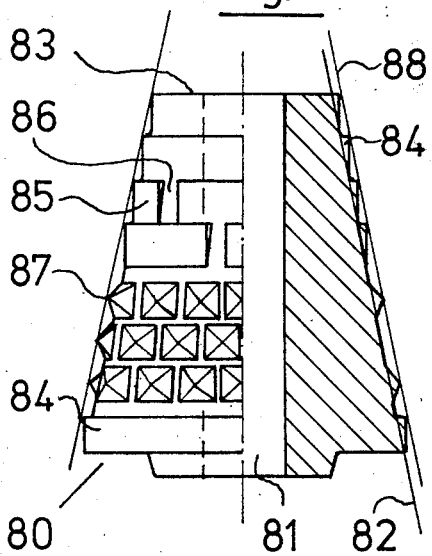
FIG. 6 is a side view partly in elevation and partly in section of another embodiment of the present invention.

A particularly advantageous embodiment of the nozzle insert, according to the present invention, is shown in FIG. 6, where the extremities of each of th elevations is intended to come into contact with the wall of the bore.

Referring now to FIG. 6, there is illustrated a cone-shaped nozzle insert 80 which has a through passage 81 and a lateral surface lying along generatrix 82. Adjacent to the narrow end 83 of the nozzle 80 the exterior surface is provided with uninterrupted or continuous rib-shaped elevations 84 extending about the circumference of the nozzle. Moving toward the thicker end of the nozzle 80, there are provided two peripheral rows of elevations 85 which is interrupted by axially extending grooves 86. Further down the axis of the nozzle 80 there are provided circumferential rows of pyramid-shaped projections 87 which are spaced from one another in each row. At the bottom of the widest portion of the nozzle 80 there is provided a continuous peripheral rib 84, again, smaller to those at the composite side of the nozzle 80.

Each of the sets of elevations or projections 84, 85 and 87 have their extremities lying along a generatrix 88 and, as in the previous embodiments, the distance being the generatrix 82 and the generatrix 88 may be of an order of magnitude which corresponds to the thickness of the joint in a conventional plane surface nozzle insert and bore. As a practical matter, the order of magnitude is a few millimeters.

As previously noted, the rib-shaped elevation 84 at the arrow end of the nozzle 80 may be so dimensioned as to function as a sealing lip which will prevent the penetration of molten metal into the joint when it is formed to protect against the mortar being washed out by the molten metal during a casting operation. It will be noted also that the axial grooves 86 provided in the broken rib 85 will permit excess motar to flow counter to the direction of insertion of the nozzle into the bore of the casting while the staggered rows of pyramid projections 87 will perform the function of dosing and distributing the applied mortar during the insertion process.

With the elevated surface portions arranged and shaped as described above and shown in FIG. 6, it will be possible to insert the nozzle 80 into the bore of a casting ladle with the extremities of each of the projections and ribs touching the surface of the bore even where an excess of mortar has been applied to the surface of the nozzle since the excess mortar will be permitted to flow from one end of the nozzle surface to the other during insertion, thus assuring that the joint between the nozzle surface and bore will be completely filled with mortar.

While the foregoing has been a description of the preferred embodiments of the present invention, it will be understood by those skilled in the art that various modifications may be made therein without departing from the spirit and scope of the invention as defined in the appended claims.

What is claimed is:

1. A protective insert for the outlet passage of a container for molten material, said outlet passage being in the form of a conical bore, said protective insert comprising a body having an axial passage and a truncated cone-shaped exterior surface having a cone axis, said conical bore of said outlet passage having an interior surface which, when said insert is disposed in said outlet passage, defines with said exterior surface of said protective insert an annular gap, said exterior surface having a plurality of elevations projecting therefrom with said elevations lying substantially along a virtual conical boundary surface coaxial with said cone axis of said exterior surface and extending in a direction inclined with respect to a plane containing said cone axis, said elevations substantially bridging said annular gap and terminating close to said interior surface of said outlet passage so that the volumetric displacement occupied by said elevations comprises a substantial portion of the volume of said annular gap.

2. The protective insert as claimed in claim 1 wherein said elevations are a plurality of circumferentially extending steps, each step having a flank portion extending generally parallel to said axial passage, and a radially extending shoulder.

3. A protective insert as claimed in claim 1 wherein said elevations comprise a plurality of circumferentially extending ribs.

4. The protective insert as claimed in claim 1 wherein said elevations are in the form of a spiral thread.

5. The protective insert as claimed in claim 1 wherein said elevations are unevenly distributed over said cone shaped exterior surface.

6. The protective insert as claimed in claim 1 wherein at least some of said elevations are in the form of individual projections extending from said cone shaped exterior surface.

7. The protective insert as claimed in claim 1 wherein said virtual boundary surface and said cone shaped exterior surface are defined by straight line generatrix each and wherein said cone shaped exterior surface narrows in the same direction as said virtual conical boundary surface.

8. The protective insert as claimed in claim 7 wherein the angle between said generatrix of said boundary surface of said cone axis is larger than the angle between said generatrix of said cone shaped exterior surface and said cone axis.

* * * * *